US006474129B1

(12) United States Patent
Anquetin

(10) Patent No.: US 6,474,129 B1
(45) Date of Patent: Nov. 5, 2002

(54) SETTING TOOL FOR EXPANDING WALL ANCHORS

(75) Inventor: Robert Anquetin, Fontaine la Riviere (FR)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/724,576

(22) Filed: Nov. 28, 2000

(30) Foreign Application Priority Data

Nov. 30, 1999 (FR) ..... 99 15074

(51) Int. Cl.[7] ..... B21J 15/04; B25B 27/00

(52) U.S. Cl. ..... 72/391.8; 72/114; 29/243.521; 29/243.527

(58) Field of Search ..... 72/391.2, 391.8, 72/114; 29/243.521, 243.527

(56) References Cited

U.S. PATENT DOCUMENTS

| | | | | |
|---|---|---|---|---|
| 3,831,424 A | | 8/1974 | James | |
| 4,086,799 A | | 5/1978 | Brendle | |
| 4,307,598 A | * | 12/1981 | Andrich | 72/391 |
| 4,625,538 A | | 12/1986 | Malagnoux | |

FOREIGN PATENT DOCUMENTS

| | | |
|---|---|---|
| EP | 0 081 345 | 6/1983 |
| EP | 0 159 255 | 10/1985 |
| FR | 2 343 564 | 10/1977 |
| GB | 2 224 230 A | 5/1990 |
| GB | 2 289 006 A | 11/1995 |

OTHER PUBLICATIONS

European Search Report dated Mar. 1, 2001 (3 pages).
Search Report dated Aug. 7, 2000 (3 pages).

* cited by examiner

*Primary Examiner*—David Jones
(74) *Attorney, Agent, or Firm*—Harness, Dickey & Pierce, P.L.C.

(57) ABSTRACT

A setting gripper (16) is disclosed for an anchor device of the type comprising two co-axial components of which each has a head with the head being spread apart co-axially during setting. The gripper (16) includes two jaws (36, 49) which are engaged between the two heads and are spread apart by a pivoting lever (20) relative to a gripper body (19) around axes (95, 111, 82, 85) which are increasingly removed from a zone of mutual contact (64, 110) between the lever (20) and a slider (21). The slider (21) defines one (49) of the two jaws, whereas the other jaw (36) is defined by the gripper body (19).

22 Claims, 6 Drawing Sheets

SETTING TOOL FOR EXPANDING WALL ANCHORS

BACKGROUND AND SUMMARY OF THE INVENTION

The present invention relates generally to a setting gripper for an anchor device of the type comprising two co-axial components of which each has a head and of which the heads are mutually spread co-axially during setting.

The discussion that follows, both with regard to prior art setting grippers and the setting gripper of the present invention, describe the construction of several components of the setting grippers, as well as the operation of the setting grippers, with references to various zones of mutual contact between various components. As such, the term "zone" is used herein to refer to an area of a particular component on which contact with an associated component is possible. In this regard, the two mutually contacting components are akin to a hypothetical cam and a hypothetical cam follower wherein the cam is movable relative to a cam follower over a predetermined area of the surface of the cam follower. The portion of the surface of the cam that is capable of contacting the surface of the cam follower would be collectively referred to as the "zone on the cam" while the portion of the surface of the cam follower that is capable of contacting the surface of the cam would be collectively referred to as the "zone on the cam follower". The zone of the cam and the zone of the cam follower collectively represent a zone of mutual contact between the cam and the cam follower.

The discussion herein is somewhat more complex, as the exemplary setting gripper of the present invention includes two pair of contacting components that have a common component. The exemplary setting gripper 16 illustrated in FIG. 3 includes a lever 20 that is movably coupled to both a gripper body 19 (via a shank 113) and a slider 21 (via a pin 110). When the term "zone" is used herein with reference to the gripper body 19, it designates an area on the gripper body 19 that is capable of contacting a corresponding area on the lever 20, such as zones 81 and 84 on the gripper body 19 which are capable of contacting zone 106 on the lever 20, or the bottom 93 and top 94 of the apertures 88 (i.e., zones 93 and 94) and the shank 113 (i.e., zone 113). Similarly, when the term "zone" is used herein with reference to the slider 21, it designates an area on the slider 21 that is capable of contacting a corresponding area on the lever 20, such as notch 64 (i.e., zone 64) and pin 110 (i.e., zone 110). When the term "zone" is used herein with reference to the lever 20, it designates an area on the lever 20 that is capable of contacting a corresponding area (or zone) on the other specified component (i.e., the one of the gripper body 19 and the slider 21 that is specifically mentioned). The corresponding zones of gripper body 19 and the lever 20 represent a zone of mutual contact between the gripper body 19 and the lever 20 whereas the corresponding zones of the slider 21 and the lever 20 represent a zone of mutual contact between the slider 21 and the lever 20.

Setting grippers for co-axial expanding wall anchors typically include:

a gripper body having an integral handle and a flat jaw perpendicular to a predetermined direction of the body;

a slider having an integral flat jaw perpendicular to said predetermined direction and placed opposite the jaw of the gripper body in said predetermined direction, the slider being guided so as to translate in said predetermined direction relative to the gripper body in the sense of moving away from the jaw of the slider relative to the jaw of the gripper body, from a relative rest position in which the two jaws are mutually adjacent and capable of being inserted together between the heads of the two components prior to setting, then in the opposite direction as they return;

a lever positioned and supported by a respectively corresponding zone in said predetermined direction against a zone of the slider and in the opposite direction against a zone of the gripper body offset in relation to said zone of the slider perpendicularly to said predetermined direction, and pivot axes perpendicular to a plane containing said predetermined direction, the lever having an integral handle and said lever and gripper body handles being disposed relative to one another and relative to said zones so as to allow the two handles to be gripped by one hand by the user in such a way that squeezing the handles together from a relative rest position moves the slider in said predetermined direction relative to the gripper body;

a holding arrangement for fixing the position of a zone of the lever perpendicular to said predetermined direction in said plane relative to the gripper body and/or to the slider; and a spring or other arrangement for returning the handles of the slider, on the one hand, and of the gripper body, on the other hand, to their respective relative rest positions.

As non-limiting examples of anchoring devices of the type concerned, expanding metal plugs of which an embodiment is described in French patent 2,546,989 and sold under the registered trade mark "Molly" and which is set when a screw is engaged coaxially therein by pulling on the head of the screw while holding the plug by a flange integral therewith and forming a head for supporting it on a hollow support in a hole of which setting is effected. Certain rivets which are set blind are also known and, in general, any anchoring device which is set blind by co-axial spreading apart of heads of components which are themselves co-axial (whatever the configuration of these heads and the nature of these components) are considered to be similar to such expanding metal plugs.

Various embodiments of grippers for the setting of such anchoring devices have been proposed, the most highly developed and the most satisfactory hitherto being described in British patent application 2,289,006, which describes a gripper of the type mentioned above in which a lever is supported on a gripper body via a pivot which is stationary relative to the lever and the body. Such an arrangement only allows a relative rotational movement about the corresponding axis, whereas the lever is also supported on a slider between this axis and the handles by way of a cam portion of the lever and an opposing part of the slider. As the handles are brought together by clenching of the user's fist, the zone of mutual support for the lever and the slider gradually moves away from the axis of articulation of the lever on the gripper body.

Thus, in an initial phase of setting of the anchor device, in particular an expanding metal plug, that is in a phase which is generally found to require a much greater force than the following phases to bring about the spreading apart of the heads of the two components (namely the screw head and the plug head in this example) the minimum value of the lever arm between the zone of mutual contact between the lever and the slider and the axis of articulation of the lever on the gripper body allows the user to apply to the heads a maximum spreading force by means of a more reasonable force applied to squeeze the handles together. This lever arm then increases progressively as the handles are brought together and as the two heads are spread apart, which means that less force is required for this purpose. When setting an expanding metal plug, in particular, it is particularly important that, after setting, the application of such a squeezing force on the handles does not risk causing the screw to tear away from the plug. The tapping in the plug, and the known gripper described in British patent application 2 289 006 is able to reconcile the need to apply a considerable force in spreading apart the heads of the screw and the plug in the initial phase of setting or starting phase of expansion, and the need to limit this force at the end of setting.

This development is more satisfactory than previously grippers, it also offers great simplicity in production and use and provides an improved guidance of the slider inside the gripper body, preventing misalignment of these two components of the anchoring device during the setting operation. However, this known gripper has a considerable number of drawbacks.

One of these drawbacks resides in the considerable frictional forces which build up between the lever cam and the counterpart of the slider as the handles are brought together, and as the anchor device is set. These forces obviously increase the force to be applied to the handles for a given resistance of the two components to the spreading apart of the heads. In particular, if a gripper of this type can be used for setting expanding metal plugs intended to cooperate with screws having a diameter of up to 6 mm, the setting of the plugs intended for larger diameter screws by means of such grippers would necessitate a force on the handles that is generally beyond the scope of an average setting tool. Furthermore, this friction causes rapid wear of the cam and/or of its counterpart on the slider.

Finally, in such a device, as the zone of mutual contact between the lever cam and its counterpart on the slider progressively moves away from the axis of articulation of the lever on the gripper body, the forces applied by the lever cam to the counterpart on the slider are necessarily markedly offset relative to the common axis of the two components of the anchor device during the majority of setting operation. This tends to move the slider out of true alignment relative to the gripper body and therefore applies additional resistance to the movement of the handles toward each other due to friction in this region.

It is the object of the present invention to overcome these drawbacks and others. The present invention preferably provides a gripper of the general type mentioned above, characterized in that it comprises a plurality of such zones of the gripper body and corresponding zones of the lever, at different distances from such zone of the slider and from the corresponding zone of the lever perpendicular to such predetermined direction on the same side of the zone of the slider and of the corresponding zone of the lever and distributed in such predetermined direction and perpendicular thereto such that the lever pivots relative to the gripper body about axes at increasing distances from said zone of the slider and from the corresponding zone of the lever in succession as the handles are squeezed together, each of said plurality of said zone of the gripper body allowing for movement of the corresponding zone of the lever, at least in said predetermined direction.

A preferred gripper according to the invention therefore retains the advantageous characteristic of increasing the lever arm as the handles are brought together as setting proceeds in a manner which is particularly well adapted to the setting of expanding metal plugs. This progression is obviously discontinuous, whereas it is continuous in the case of a gripper according to the teachings of the aforementioned British patent application owing to the cooperation between the lever cam and the counterpart on the slider. Experience has shown that such a discontinuity is quite acceptable if there is an adequate number of cooperating zones of the body and the lever and if their distribution (in the sense of moving away from the cooperating zones of the slider and the lever) is selected appropriately. In the case of a gripper intended for the setting of expanding metal plugs, three of such cooperating zones of the gripper body and of the lever are usually considered sufficient, but a different number could be selected without departing from the scope of the present invention.

Also, the method of cooperation according to the present invention between the lever, on the one hand, and the gripper body and the slider, on the other hand, has significant advantages over the method of cooperation recommended in the aforementioned British patent application. In fact, the range of variation of the lever arm may be much greater as it can be distributed over the entire size of the lever between its zone cooperating with the slider and the handle of the lever and in a corresponding manner on the gripper body whereas the size of the cam and of its counterpart on the slider, perpendicularly to the direction of sliding thereof, in the case of a gripper according to the aforementioned British patent application is necessarily much more limited, in particular on account of the design of the slider and its cooperation with the gripper body.

Furthermore, the friction occurring, in a gripper according to the invention, between the cooperating zones of the lever and the gripper body apply much lower resistance to squeezing the handles together than that occurring between the lever cam and its counterpart on the slider in the case of a gripper according to the aforementioned British patent application. Thus, the performance of a gripper according to the invention is improved over that of a gripper according to the aforementioned British patent application in terms of spreading force applied to the heads of the two components of the anchor device relative to the force applied to squeeze the handles together.

In addition, the position of the cooperating zones of the slider and of the lever perpendicular to the direction of translation of the slider varies far less in the case of a gripper according to the invention than in the case of a gripper according to the teaching of the aforementioned British patent application, thus making it is possible to keep them sufficiently close to the axis of the two components of the anchor device. This makes the tendency of the slider to rock relative to the gripper body to remain particularly moderate, in fact virtually negligible, so that the friction occurring between the slider and the gripper body is much lower than in the case of a gripper according to the teaching of the aforementioned British patent application. This further increases the performance of the gripper according to the present invention as defined herein before.

The arrangement for holding a zone of the lever relative to the body of the gripper and/or to the slider can be located in cooperating zones of the lever and of the slider, which are mounted so as to rotate relative to one another about an axis which is stationary relative to the lever and relative to the slider which enables this axis to be passed in the immediate vicinity of the common axis of the two components of the anchor device to be set. Thus this favorably enables the force of the lever to be applied to the slider virtually in the axis of these parts. However, this results in the pivoting of the lever relative to the gripper body being accompanied by relative sliding perpendicular to the direction of translation of the slider relative to the gripper body even in the region of the cooperating zones of the lever and of the gripper body closest to the cooperating zones of the slider lever that is even in a configuration in which the forces applied (in particular between the lever and the gripper body) are the highest, and consequently causes similarly high friction.

Consequently, it is preferable to adopt a compromise whereby the holding arrangement or components are located in one of said zones of the gripper body and of the slider and in the corresponding zone of the lever and to adopt a comprise arrangement for mutual immobilisation against any relative translation at least approximately perpendicularly to said predetermined direction, whereas the others of said zones of the gripper body and of the slider and the respectively corresponding zones of the lever allow a relative movement approximately perpendicularly to said direction.

More precisely, it is preferable if said holding arrangement includes, in the zone of said zones of the gripper body closest to said zone of the slider and in the corresponding zone of the lever, arrangement for guidance in relative translation at least approximately in said predetermined direction. Therefore, if the rotation of the lever relative to the gripper body is effected by their cooperating zones closest to the cooperating zones of the lever and the slider that is if the forces between the lever and the gripper body are greatest, their relative movement is virtually exclusively a rotational movement and the losses by friction in this region are reduced to a minimum.

Advantageously, therefore, the other zone, of which there is at least one, of said zones of the gripper body or the corresponding zone of the lever comprises a convex surface in the form of part of a cylinder of revolution about the corresponding axis, for the support of this zone of the lever on this zone of the gripper body in the direction opposed to said predetermined direction. This is a particularly simple method of allowing the necessary rotation, the clearance required to substitute one axis for another during the pivoting of the lever relative to the gripper body, and a relative translation perpendicularly to the direction of translation of the slider relative to the gripper body in their cooperating zones.

Furthermore, the zone of the slider and said corresponding zone of the lever are preferably designed in such a way that they provide for guidance in relative translation at least approximately perpendicular to said predetermined direction in order to maintain of relative deflection in this direction also at this level.

It might be observed that the relative translation movements in the region of the cooperating zones of the slider and of the lever and of the cooperating zones of the gripper body and of the lever apart from those in which the holding arrangement or components are located are necessarily accompanied by friction which affects the performance of the gripper as defined above. However, it will also be observed that this friction is manifested essentially after the starting phase of setting which is carried out by pivoting the lever over the gripper body by its zones processed to the cooperating zones of the zone of the slider and the corresponding zone of the lever in the preferred position of the holding means which ensure pure relative rotation, on the one hand. It will also be observed that the aforementioned preferred configuration of the other cooperating zones of the lever and of the gripper body as well as of the lever and the slider allow the relative travel subjected to friction to be reduced considerably in comparison with the case of a gripper according to the teaching of the aforementioned British patent application, to the extent that the gripper according to the invention has both better performance and greater convenience in use.

If, as preferred, the cooperating zones of the slider and of the lever include an arrangement for guidance in relative translation at least approximately perpendicular to the direction of translation of the slider relative to the gripper body, elastic components for returning the handles in a spreading direction toward their relative rest position, according to a preferred embodiment of the gripper according to the invention, also ensure that the slider and the gripper body are returned to their relative rest position.

The configuration of the gripper according to the invention should be adapted to the configuration of the anchor devices which it is intended to set, this being the case, in particular, with the configuration of its jaws. For example, if the gripper is intended to set expanding metal plugs or other anchor devices of which one of the components include a shank integrally carrying its head and issuing from the other component in the region of its head, the two jaws advantageously have, in a same plane including said predetermined direction and constituting a mean plane of symmetry common to the slider and to the gripper body, a respective notch for engagement on one of the two components which comprises the shank, the two notches being open on either side in said direction and in a direction perpendicular thereto to allow the shank to pass between the two heads.

For ease of maintenance or else to allow adaptation of one gripper to different anchor devices, such as to satisfy a wide range of dimensions and/or configurations of the components of these anchor devices, the two jaws are preferably interchangeable. This can be provided by way of the interchangeability of the entire slider with regard to its jaw and by way of the fact that the gripper body includes an interchangeable nose constituting the corresponding jaw. For the same purpose, the cooperation between at least one of the jaws and the corresponding component of the anchor device is achieved by way of an appropriately configured adaptor attached integrally but removably, for example by magnetic fixing, to this jaw.

Further characteristics and advantages of a gripper according to the invention will emerge from the following description relating to a non-limiting exemplary embodiment but corresponding to the currently preferred embodiment, and from the accompanying drawings and claims which form an integral part of this description.

DETAILED DESCRIPTION OF THE PREFERRED EMBODIMENTS

Although an exemplary gripper according to the invention is described with reference to the setting of a metal anchor plug of the type described in French patent 2 546 989, a plug of this type merely constitutes a non-limiting example of anchor device capable of being set using a gripper according to the invention.

Figures 1, 2, 3:
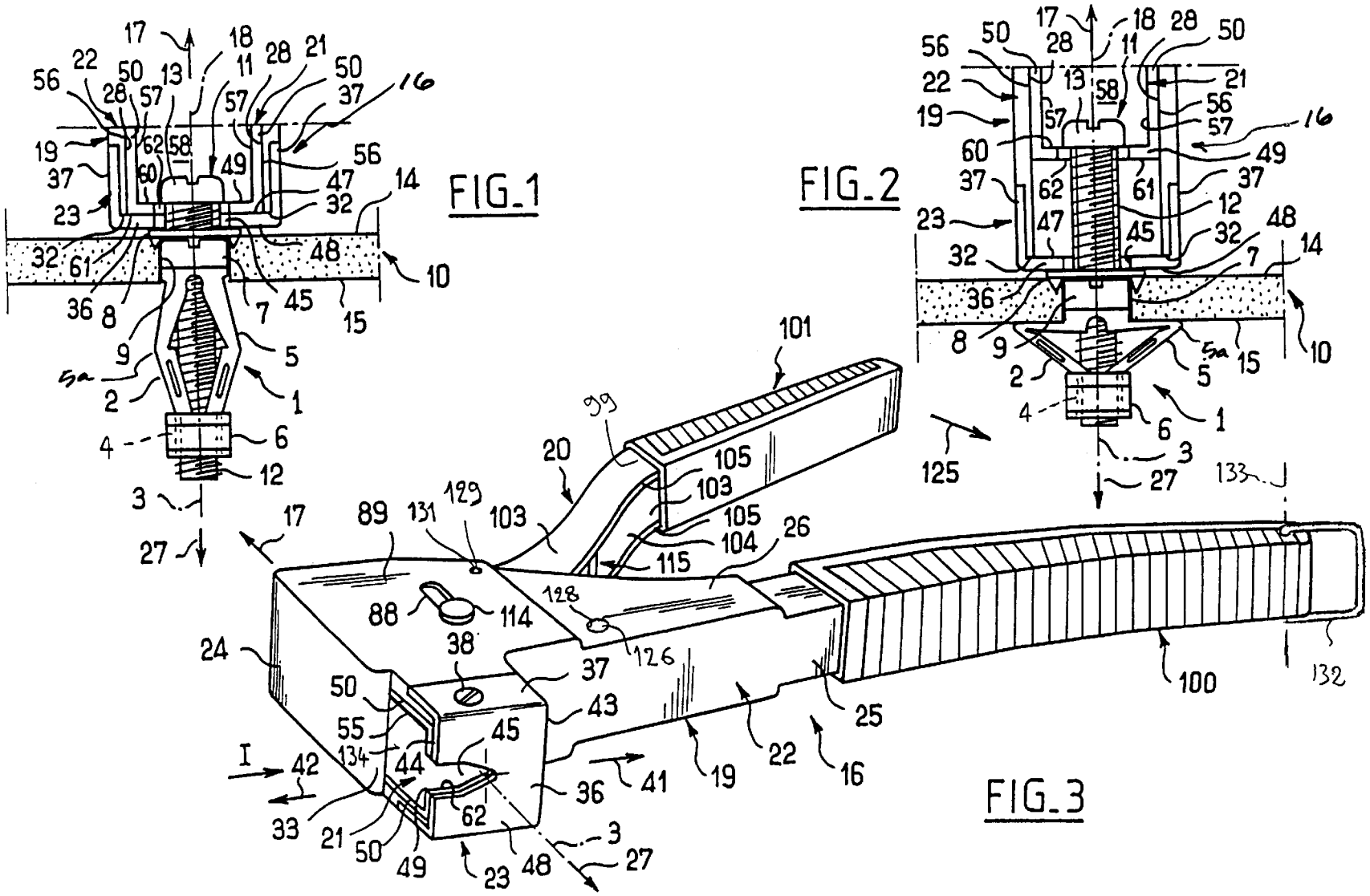
FIGS. 1 and 2 show the beginning and end of the setting of a prior art metal anchor plug of the type described in French patent 2,546,989 on a generally horizontal hollow wall, such setting being carried out from above using a gripper according to the invention viewed from the end in a direction designated I in FIG. 3, the partition, for its part, being viewed in section through a plane passing through the common axis of the plug and the screw which is associated with it and has a flat head here.
FIG. 3 is a perspective view of a gripper according to a preferred embodiment of the present invention.

Referring to FIGS. 1 and 2, it will be noted that a metal anchor plug of this type comprises a body 2 which is symmetrical about a longitudinal axis 3 and is essentially formed by four longitudinal branches 5 uniformly distributed angularly or circumferentially around the axis 3 and joining two longitudinally extreme transverse rings 6 and 7 together integrally by producing a single part. The ring 6 integrally holds a coaxial nut 4 whereas the ring 7 carries, preferably removably, a head 8 in the form of a transverse annular flange surrounding the ring 7 extending radially in a direction away from the axis 3. Between the rings 6 and 7, at the same longitudinal distance from each of them, the branches 5 each have an elbow 5*a* so as to have a shape which is generally curved in the direction away from the axis 3.

A plug 1 of this type is intended to be anchored coaxially in a hole 9 in a wall 10, through which it passes along its axis 3, and to anchor, with respect to this wall 10, a screw 11 of which the shank 12 is threaded coaxially in the nut 4 held by the ring 6. The screw 12 preferably has a head 13 longitudinally facing the head 8 of the plug 1. The head 13 is preferably a flat head which is connected to the shank 12 by a plane annular shoulder perpendicular to the axis 3 in the example illustrated in FIGS. 1 and 2. It will become apparent, however, that a gripper 16 according to the invention (shown partially in FIGS. 1 and 2) can also be used for setting plugs 1 equipped with a countersunk screw of which the aforementioned shoulder has the form of a truncated cone of revolution about the axis 3 rather than being plane and perpendicular thereto.

A plug 1 of this type is set blind into the wall 10 exclusively from one 14 of two mutually parallel faces 14 and 15 thereof. Firstly, the wall 10 is perforated from its face 14 and along an axis perpendicular to this face 14 with a hole 9 of appropriate diameter, then the plug 1 is inserted coaxially into this hole 9 until the head 8 of the plug 1 rests flat against the face 14 around the hole 9. In general, this operation is typically carried out with the plug 1 already equipped with the screw 11, threaded by way of shank 12 into the nut 4, held by the ring 6, and having its head 13 longitudinally opposite to the head 8 of the plug 1. Alternatively, the screw 11 can be engaged with the plug 1 while taking care to keep the head 13 at a slight longitudinal or axial distance from the head 8 to allow insertion of a portion of a setting gripper, in particular the gripper 16 according to the invention, as described below. The head 13 is then held by the gripper 16 along the axis 3 in the direction 17 away from the head 8 while keeping the head 8 applied flat against the face 14 round the hole 9, without allowing the screw to turn around the axis 3 relative to the plug 1. The branches 5 are deflected away from the axis 3 by bending at each elbow 5*a* relative to the two rings 6 and 7 and into a longitudinally central zone between them. This deflection is continued until the halves of the branches 5 closest to the ring 7 are urged flat to the face 15 of the wall 10 around the hole 9. The plug 1 is then held by the wall 10, which is gripped between the head 8 and the branches 5 deflected in this way, whereas the ring 7 fits within the interior of the hole 9 without clearance or at least virtually without clearance. The screw 11 can then be unscrewed from the nut 4 of the ring 6 of the plug 1 can be used to anchor an article to be suspended or mounted on the wall 10.

The gripper 16 according to the invention, which is illustrated in FIGS. 1 to 13, includes three main components which are movable relative to one another and are respectively symmetrical about a plane 18 including the axis 3. These components are a rigid gripper body 19, which carries the two other main components, a rigid lever 20 articulated about the gripper body 19 generally symmetrical about the plane 18, and a rigid slider which is movable in translation inside the gripper body 19 under the influence of the pivoting of the lever 20 relative thereto in a predetermined longitudinal or axial direction along the axis 3.

The gripper body 19, as shown in FIGS. 3 through 6 is advantageously produced from a single piece 22 of cast metal, for example, apart from a nose 23 which is attached removably and interchangeably to this single piece or part 22, which nose 23 will be described in more detail hereinafter. The part 22 defines around the axis 3, a housing 24 which is longitudinally elongated along the axis 3. The part 22 further defines a handle 25 which is transversely elongated along a mean axis 35 perpendicular to the axis 3 and projecting from this axis 3 on one side relative to the housing 24. The handle 25 is longitudinally smaller than the housing 24 which it is connected at or by way of a transition zone 26. The longitudinal dimension of the zone 26 tapers outwardly to increase progressively from the handle 25 toward the housing 24 in a direction toward the axis 3. The housing 24, the handle 25 and the transition zone 26 are respectively symmetrical about the plane 18 in which the mean axis 35 of the handle 25 is situated. Perpendicularly to this plane 18, the handle 25 has dimensions smaller than those of the housing 24 whereas the transition zone 26 has dimensions intermediate between those of the handle 25 and those of the housing 24.

The housing 24 is generally hollow, preferably having a generally tubular shape or a generally U-shape surrounding the axis 3 but is open toward a direction 17 during setting and also in an opposite direction 27. Transversely or perpendicularly to the axis 3, the housing 24 has a constant rectangular internal cross-section defined in part by two plane faces 28 which are themselves preferably rectangular and identical to one another and which are parallel to, and mutually symmetrical about, the plane 18. The housing 24 is also defined by two plane faces 29 and 30 (see FIG. 4) which are also preferably rectangular and respectively symmetrical about the plane 18 and parallel to the axis 3. The two faces 29 and 30 join together the faces 28 on respective sides of the axis 3 remote from the handle 25 and on the side of the gripper 16 that includes the handle 25.

In the direction 17, the four faces 28, 29 and 30 end in the same region by way of respective connection to a transverse edge 31 (see FIG. 4) of the housing 24. In the direction 27, on the other hand, the two faces 28 extend to respective edges 32 (see FIGS. 1, 2 and 4) of the housing 24, with the two edges 32 being located in a same geometric plane perpendicular to the axis 3. The face 29 extends (and beyond) to an edge 33 of the housing 24, with the edge 33 also being located in a geometric plane perpendicular to the axis 3 but broadly set back from the geometric plane of the edges 32. The face 29 also extends to an edge 34 (see FIG. 4) of the housing 24, with the edge 34 being located in a geometric plane perpendicular to the axis 3 and located between the respective geometric planes of the edges 32 and of the edge 33such that the face 29 is set back in the direction 17 from the common geometric plane of the edges 32 but remaining closer to this plane than that of the edge 33.

The housing 24 internally receives and guides a slider 21 in transitional movement along the axis 3 in directions 17 and 27 relative to the part 22 and the gripper body 19, while preventing any other relative movement. In the direction 27, however, the translation of the slider 21 inside the housing 24 is limited by the nose 23 which, as shown in particular in FIGS. 1 through 4, is configured and attached to the housing 24 so as partially to block or cover it in the direction 27. More precisely, the nose 23 which is rigid and produced, for example, from drop-forged sheet metal or from a metal extrusion, is symmetrical about the plane 18 and has a U-shaped section when viewed in section through a plane perpendicular to the direction 35 of the handle 25 when it is fixed to the part 22 so as to constitute the gripper body 19.

The nose 23 includes, in a single part, a flat core 36 having a plane face 47 flat against the two edges 32 of the housing 24. The nose 23 thus closes the housing 24 in the direction 27 and has two wings 37, which are also flat as well as being symmetrical about and parallel to the plane 18. Each of these wings 37 fit within respective rebates made on the exterior of the housing 24 in the immediate vicinity of a respective edge 32 and extending axially such that the nose 23 fits on the housing 24 in the direction 17. Each wing 37 is held thereon by a respective screw 38 engaged along an axis 39 perpendicular to the plane 18 in a corresponding non-designated hole in the wing 37 and threaded into a corresponding hole 40 in the housing 24, without projecting to the interior thereof relative to the corresponding face 28. The bearing of the core 36 against the edges 32 of the housing 24 and the fitting of the wings 37 secured thereon by the screws 38 ensure that the nose 23 is fixed relative to the part 22, while still allowing removal and replacement of the nose 23.

Figure 7:
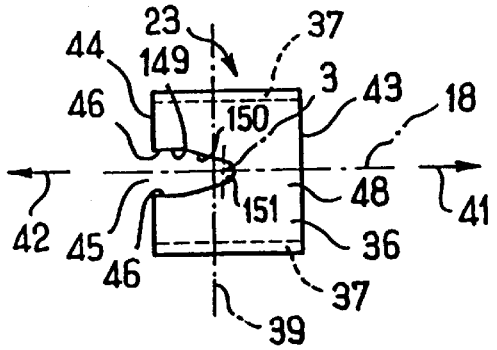
FIG. 7 is a view of the jaw of the gripper body from below in a direction designated VII in FIG. 4.
Figure 8:
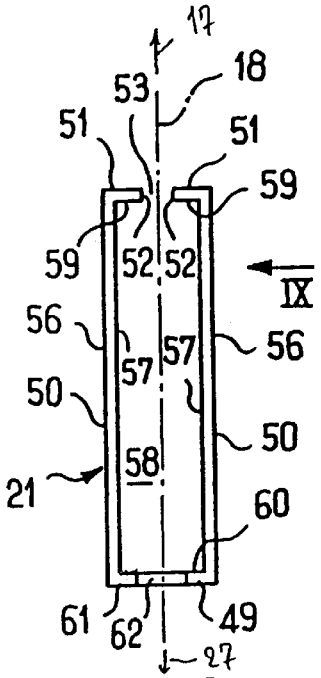
FIG. 8 is an end view, in a direction designated VIII in FIG. 4 and corresponding to the direction designated I in FIG. 3, of the slider accommodated inside the gripper body in this example.
Figure 10:
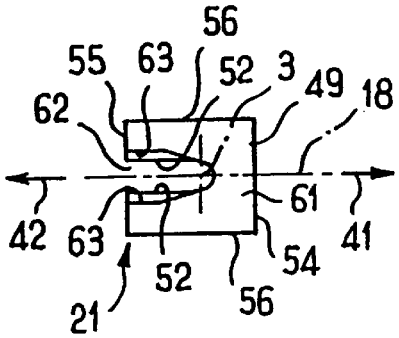
FIG. 10 is a view of the jaw of the slider from below in a direction designated X in FIG. 9, the slider having the orientation which it has when the gripper has the orientation illustrated in FIG. 4.
Figure 9:
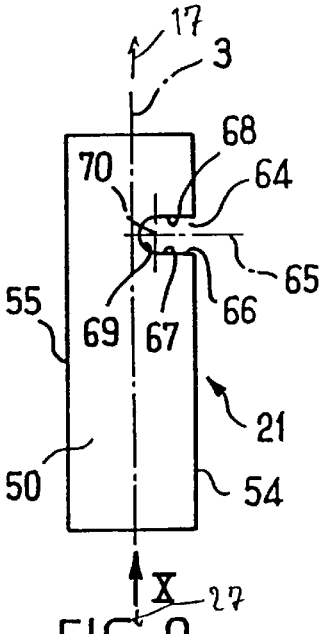
FIG. 9 is an elevation of this slider in a direction designated IX in FIG. 8.
Figure 11:
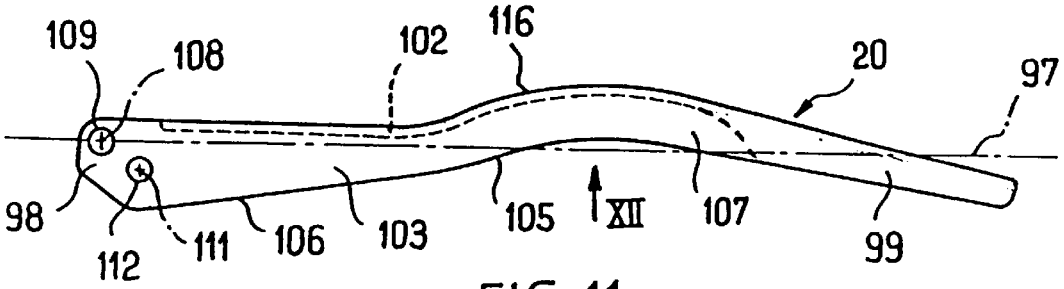
FIG. 11 is an elevation of the actuating lever of the slider, this elevation corresponding to that in FIG. 4 in which the lever is illustrated in a generally horizontal orientation.
Figure 12:
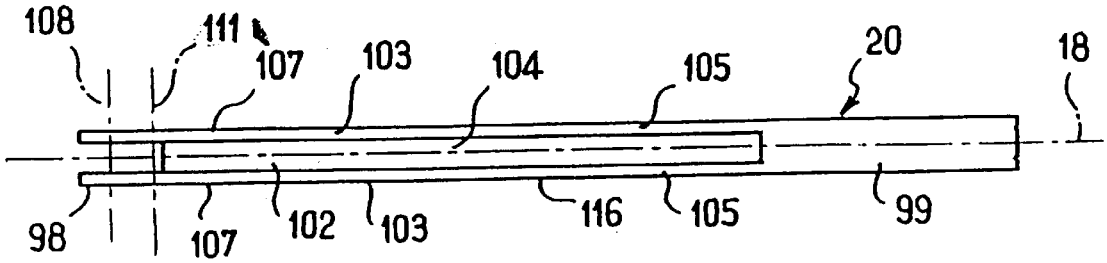
FIG. 12 is a view from below of the lever having this orientation of FIG. 11, looking in the direction designated XII in FIG. 11.

In both directions 41 and 42 perpendicular to the axis 3 and located in the plane 18, with direction 41 being the one in which the handle 25 projects from the housing 24, the core 36 and the two wings 37 of the nose 23 are delimited by respective edges 43 and 44 which, as shown in FIG. 7, is plane and parallel to the axis 3 and oriented perpendicular to the plane 18 relative to which each of the edges 43 and 44 is respectively symmetrical.

The edge 43 facing in the direction 41 is continuous, but the edge 44 facing in the direction 42 has a discontinuity in the region of the core 36 in the form of a notch 45 traversing the core 36 longitudinally on either side symmetrically about the plane 18 while surrounding the axis 3 but spaced apart from the edge 43. More precisely, the notch 45 is delimited by two flanks 46 which are symmetrical to one another about the plane 18 and connected to the edge 44 in the direction 42, the two flanks 46 being joined together in the direction 41. Each flank 46 is connected respectively in the direction 17 and in the direction 27 to the plane face 47 of the core 36 facing in the direction 17. The flanks 46 rest flat against the edges 32 of the housing 24. The flanks 46 also extend to the plane face 48 of the core 36 parallel to the face 47 and consequently perpendicular to the axis 3 and face away from the face 47 toward the exterior of the housing 24 in the direction 27.

As shown is FIG. 7, for example, each of the flanks 46 has, at its connection to the edge 44, a plane zone 149 which is parallel to the plane 18 and extends in the direction 41 from the edge 44 over about half of the distance separating it from the axis 3. In the direction 41, each zone 149 is connected to a zone 150 of the flank 46 which is also plane but oblique relative to the plane 18 so as to extend toward the plane 18 in the direction 41 (but without intersecting it) to a distance from the edge 44, in the direction 41, which is slightly greater than the distance separating the axis 3 from this edge 44. Around this axis 3, the zones 150 of the two flanks 46 are joined together by a concave bottom zone 151 in the form of a portion of a cylinder of revolution about the axis 3, with a diameter corresponding substantially to the smallest diameter of the shank 12 of the screw 11 in a plug 1 capable of being set by the gripper according to the invention. The mutual spacing between the two zones 149 perpendicularly to the plane 18 is, for its part, substantially equal to or slightly greater than the greatest diameter of the shank 12 of the screw 11. The nose 23 on the gripper body 19, with its core 36, thus constitutes one of the jaws of the gripper 16, with the other jaw being constituted by the slider 21 (see also FIG. 9).

As shown more particularly in FIGS. 4 and 8 to 10, the slider 21, like the housing 24, has a shape which is elongated longitudinally or axially along the axis 3, but its dimensions along this axis 3 are smaller than the internal dimension of the housing 24 measured between the edge 31 and the edges 32. The slider 21 can be produced from drop-forged sheet metal or from an extruded metal profile and, when viewed through a sectional plane perpendicular to the axis 35, has a C-shaped section symmetrical about the plane 18.

The slider 21 includes a flat core 49 perpendicular to the axis 3 and to the plane 18 about which it is symmetrical. The flat core 49 of the slider 21 constitutes a jaw for the gripper 16, with this jaw cooperating with the jaw formed by the core 36 of the nose 23 of the gripper body 19. The flat core 49 interconnects two wings 50 which are also flat and elongated parallel to the axis 3. The wings 50 are identical to one another and symmetrically disposed about the plane 18 to which they are parallel. Two flat flanges 51 are disposed at the opposite ends of the wings 50 relative to the core 49. The flanges 51 are directed toward one another, parallel to the core 49 and perpendicular to the plane 18 about which they are symmetrical to one another, but extend inwardly short of this plane 18 toward which they have respective plane edges 52 parallel to the plane 18. The two edges 52 thus leave a clear slot 53 between themselves. The core 49, the two wings 50 and the two flanges 51 are delimited respectively in the direction 41 and in the direction 42 by plane edges 54 and 55 which are perpendicular to the plane 18 and parallel to the axis 3. In the direction away from the plane 18, the wings 50 are delimited by a respective plane rectangular faces 56. The distance separating the edges 54 and 55 is substantially equal to the distance separating the internal faces 29 and 30 of the housing 24. The distance separating the faces 56 of the wings 50 is substantially equal to the distance separating the internal faces 28 of the housing 24. Thus a sliding contact for guiding the slider 21 during sliding movement parallel to the axis 3 inside the housing 24 is established between the edges 54 and 55 and the faces 30 and 29, on the one hand, and between the faces 56 and the faces 28, on the other hand.

The wings 50 also have faces 57 which are also plane and are parallel to the plane 18, with the faces 57 symmetrically facing one another about the plane 18. These faces 57 delimit between themselves a space 58 inside the slider 21 which is open in the direction 42. In the direction 17, this space 58 is closed on either side of the slot 53 by plane faces 59 of the two flanges 51, with the plane faces 59 being disposed in the same geometric plane and extending perpendicular to the axis 3. In the direction 27, the space 58 is closed by a plane face 60 of the core 49, which is perpendicular to the axis 3. The core 49 is otherwise delimited in the direction 27, by a further plane face 61 perpendicular to the axis 3 and placed directly opposite the face 47 of the core 36 of the nose 23 along the axis 3. In a rest position of the slider 21 inside the housing 24, which constitutes the position illustrated in FIG. 1 and in FIGS. 3 and 4, the core 49 abuts, by way of its face 61, the face 47 of the core 36. But the core 49 can move away from the core 36 in the direction 17 by sliding movement of the slider 21 inside the housing 24 and can also return to this rest position by sliding movement of the slider 21 conversely in the direction 27 inside the housing 24.

In its edge 55 facing in the direction 42, the core 49 of the slider 21 is recessed by a notch 62 which is identical in every way to the notch 45 in the core 36 of the nose 23, with the two notches 62 and 45 thus being exactly superimposed along the axis 3 in the rest position of the slider 21 relative to the housing 24. In particular, the notch 62 is delimited on either side of the plane 18 by a flank 63 which is identical in all ways to the respective flank 46 of the notch 45 located on the same side of the plane 18, and thus each flank 63 longitudinally coextends with a respective flank 46.

Furthermore, the faces 57 of the wings 50 are spaced apart perpendicularly to the plane 18 by a distance at least equal to the greatest diameter of the head 13 of the screw 11 compatible with the range of plugs for which the gripper 16 is intended. Furthermore, in the rest position of the slider 21, there remains between the face 60 of the core 49 of the slider 21 and the edge 33 of the housing 24 a space 134 which is open in the direction 42 has a dimension parallel to the axis 3 at least equal to the greatest thickness which the head 13 of the screw 11.

Thus, while the slider 21 occupies its rest position relative to the gripper body 19, the core 36 of the nose 23 and the core 49 of the slider 21 can be inserted in the direction 42 around the shank 12 of the screw 11. The head 13, for this purpose, is spaced sufficiently from the head 8 of the plug 1 to a position illustrated in FIGS. 1 and 2 to allow the shank 12 to be disposed in the bottom of the superimposed notches 45 and 62. Thus the face 48 of the core 36 of the nose 23 rests flat against the head 8 of the plug 1 and the face 60 of the core 49 of the slider 21 is beneath and in contact with the head 13 of the screw 11 if the distance separating the head 13 from the head 8 along the axis 3 is equal to the cumulative thickness of the two cores 36 and 49. The axis 3 of the screw 11 and the plug 1 is placed in the plane 18 perpendicularly to the faces 48 and 60.

The two cores 46 and 47 superimposed in this way constitute, for the gripper 16, two jaws capable of being spread from their rest position, during which movement the jaw constituted by the core 36 of the nose 23 holds the head 8 of the plug 1 whereas the jaw constituted by the core 49 of the slider 21 pulls the head of the screw 11 in the direction shown diagrammatically at 17 in FIG. 2. This causes the anchoring of the plug as described above. It is then easy to release the two jaws from the assembly formed by the screw 11 and the plug 1 by a moving the gripper 16 in the direction 41 relative to the screw 11, at least after having brought the slider 21 back to its rest position relative to the gripper body 19.

The movements of the slider 21 relative to the gripper body 19 are caused by action of the setting tool on the lever 20. To cooperate with this lever 20, the two wings 50 of the slider 21 have, recessed in the edge 54 (at a location closer to the flanges 51 than the core 49) two notches 64 (see FIG. 9) which are symmetrical to one another about the plane 18 along a same mean plane 65 perpendicular to the axis 3. Each of these notches is delimited by an edge 66 opening in the two faces 56 and 57 of the respective wing 50. The edges 66 include two plane flanks 67 and 68 which are parallel and symmetrical with respect to the plane 65 and face turned in the direction 17 and in the direction 27 respectively. Remote from their connection to the edge 54, the flanks 67 and 68 of each edge 66 are joined together by a respective concave bottom 69 generally forming a half cylinder of revolution about an axis 70 perpendicular to the plane 18 and situated in the plane 65.

For receiving the lever 20, the part 22 for its part comprises a passage 72 opening in the face 30 inside the housing 24. The passage 72 also opens toward the exterior of the housing 24 in a plane face 73 perpendicular to the plane 18 generally facing the direction 17 and delimiting a transition zone 26 between the housing 24 and the handle 25. The passage 72 is located in the transition zone 26 along a mean axis 71 located in the plane 18 intersecting the axis 3 at the same point as the axis 35 and progressively extending away from it while forming an angle of about 30° therewith in the direction 41 away from the axis 3 on the same side of the axis 3 as the handle 25. This face 73 is connected to the edge 31 of the housing 24 toward the axis 3 and is connected to the handle 25 in a direction away from the axis 3, while having obliqueness relative to the axis 35 which is almost the reverse of that of the axis 71. More precisely, the passage 72 is delimited in a direction away from the plane 18 by two plane faces 74 parallel to plane 18 and symmetrical to one another about it. These faces 74 join together the faces 30 and 73 and are spaced apart perpendicularly to the plane 18 by a distance smaller than the distance separating the interior faces 28 of the housing 24.

The passage 72 is also delimited by two faces 75 and 76 that are perpendicular to the plane 18 and spaced symmetrical about it. The face 75, which is parallel to the axis 71 and situated on the same side of it as the edge 31, is plane and parallel to the axis 71 and joins the faces 74 together perpendicularly to the plane 18 and the faces 30 and 73 parallel to the axis 71. The connection to the face 73 is obtained by way of an intersected plane 77 perpendicular to the plane 18 and parallel to the axis 3, producing the connection to the face 73 in the region of its connection to the edge 31.

The face 76 (which is located opposite the face 75 in a position approximately symmetrical to that of the face 75 about the axis 71) includes a plurality of zones which sequentially follow one another parallel to the axis 71 from its connection to the internal face 30 of the housing 24 to its connection to the face 73. The face 76 is defined in each of these zones by generatrices perpendicular to the plane 18 and joining the two faces 74 together from its connection to the face 30 up to its connection to the face 73. Thus, from its connection to the face 30 to its connection to the face 73, the face 76 includes in succession in a direction defined by the axis 71:

- a plane zone 78 parallel to the axis 71 and to the face 75 from which it is spaced perpendicularly to the axis 71 by a distance far greater than that separating the faces 74 perpendicularly to the plane 18;
- a concave zone 79, for example in the form of a portion of cylinder of revolution about a non-designated axis, perpendicular to the plane 18, so as to produce a transition with the following zone;
- a plane zone 80 turned toward the axis 3, in other words in the direction 42, and having obliqueness relative to the axis 35 which is more pronounced than that of the zone 78, while being orientated, for example, at about 45° to the axis 35 so as to form a projection relative to the zone 78;
- a convex zone 81 in the form of a portion of a cylinder of revolution about an axis 82 perpendicular to the plane 18 and located further from the axis 3 than the zone 80;
- a plane zone 83 thus connected to the zone 80 by the zone 81 and being at an inclination to the axis 71 which is such that this zone 83 moves slightly away from it in a direction away from the axis 3, approximately in the direction 41;
- a convex zone 84 generally in the form of quarter cylinder of revolution about an axis 85 perpendicular to the plane 18;
- a plane zone 86 thus connected perpendicularly by the zone 84 to the zone 83 and facing in a direction going away from the axis 3 approximately in the direction 41; and a plane zone 87 parallel to the zone 83 but set back relative to it so that the zones 79, 80, 81, 83, 84, 86 form a boss which projects relative to the zones 78 and 87 which are disposed approximately in the extension of one another apart from the slight obliqueness of the zone 87 relative to the zone 78 resulting from its obliqueness common to the zone 83 relative to the axis 71.

As explained below, the zones 81 and 84, in turn, act as a bearing means for the lever 20 approximately in the direction 27 relative to the gripper body 19, while allowing relative rotation about the axis 82 and about the axis 85 respectively.

In order to cooperate with the lever 20, the part 22 of the gripper body 19 has, at the connection between the transition zone 26 and the housing 24, two apertures 88 which open perpendicular to the plane 18 into the passage 72 by way of respective faces 74 thereof. The apertures 88 also open toward the exterior of the passage 72 by way of respective external faces 89 of the part 22 of the gripper body 19, the two faces 89 facing in a direction away from the plane 18. The faces 89 are parallel and symmetrical about the plane 18 and define, in the immediate vicinity of the edges 32, the aforementioned rebates for receiving the wings 37 of the nose 23.

The apertures 88 which are symmetrical to one another about the plane 18 are preferably oblong in a direction parallel to the axis 3 and are respectively symmetrical about a mean plane 90 perpendicular to the plane 18 and parallel to the axis 3. Each aperture 88 is delimited by an edge 91 including two plane flanks 92 which are symmetrical to one another about the plane 90 to which they are parallel, and further delimited by two concave bottoms 93 and 94 generally in the form of half cylinders of revolution about respective axes 95 and 96 perpendicular to the plane 18. These two bottoms 93 and 94 joining together the two flanks 92 while facing respectively in the direction 17. This delimits the corresponding aperture 88 toward the face 76 of the passage 72 and, in the direction 27, delimits the corresponding aperture 88 toward the face 75 of the passage 72. The dimension of each aperture 88 in a direction parallel to the axis 3 is smaller than the distance separating the zone 78 from the face 76 and the face 75 parallel to the axis 3.

To cooperate with the slider 21 and the gripper body 19, the lever 20 is designed in a manner described below with reference to FIGS. 3, 4, 11, 12 and described in a rest position relative to the gripper body 19 when the slider 21 itself is in its rest position relative thereto, this rest position being illustrated in FIGS. 3 and 4. The approximately rectilinear lever 20 has a mean axis 97 which coincides in this position with the axis 71 of the passage 72 such that the lever 20, which project from the same side of the axis 3 (relative to the housing 24 of the gripper body 19) as does the handle 25, moves away from the handle 25 from an extreme zone 98 accommodated inside the slider 21 so as to cooperate therewith, to an extreme zone 99 forming a handle which a user is able to grasp with the same hand as the handle 25 in an attempt to squeeze these two handles together by rocking the lever 20 relative to the gripper body 19. To this end, the end zone forming a handle 99 is located outside the passage 72 opposite the handle 25 and offset from it in the direction 17. The users comfort when gripping the handles 25 and 99 may be improved by respective handle sheaths 100 and 101, which can be made of a suitable material, such as a synthetic rubber, for example.

The lever 20 can be advantageously produced from cast metal and has (over the majority of its dimension along the axis 97 apart from the extreme zones 98 and 99) a U-shaped cross-section running perpendicularly to the axis 97. This cross-section is defined by a core 102 perpendicular to the plane 18 and extending over the entire dimension of the lever 20 along it axis 97 (apart from the extreme zone 98) and by two flat wings 103 which are symmetrical to one another about the plane 18 to which they are parallel. These two wings 103 extend over the entire dimension of the lever 20 along its axis 97 (apart from the extreme zone 99) toward which the core 102 thickens so that the lever is solid in this extreme zone 99.

The two wings 103 form a projection toward the handle 25 so as to define, along with the core 102, a chute 104 facing the handle 25 and the face 76 of the passage 72 for a purpose explained below. In a direction away from the core 102, the wings 103 are delimited by a respective edge 105 which has a plane zone 106 at least over a proportion of the dimension of the lever 20 along its axis 97 from the extreme zone 98. More specifically, this plane zone 106 extends at least over the entire portion of the lever 20 likely to be located within the passage 72 in view of the pivoting of the lever 20 relative to the gripper body 19. The zones 106 of the two edges 105 are mutually co-planar, along a same geometric plane perpendicular to the plane 18, which approaches the axis 97 in a direction from the extreme zone 98 toward the extreme zone 99.

To allow the engagement of the extreme zone 98 of the lever 20 inside the slider 21 and the engagement of the lever 20 in the passage 72 between its extreme zones 98 and 99 and to allow the pivoting of the lever 20 relative to the gripper body 19, the lever 20 has (between the zones 106 of the edges 105 and the core 102, perpendicularly to a direction defined by its axis 97) a maximum dimension substantially smaller than the minimum dimension separating the faces 76 and 75 perpendicularly to the axis of the passage 72. Thus minimum dimension is itself smaller than the distance separating the faces 59 from the face 60 of the slider 21 along the axis 3. The wings 103 are delimited, in the direction away from the plane 18, by plane faces 107 parallel to the plane 18. The plane faces 107 are symmetrical with respect to and spaced perpendicularly to this plane 18. The dimension of this spacing is substantially equal to the smaller of the dimension separating the faces 74 of the passage 72 perpendicularly to the plane 18 and the dimension separating the faces 57 of the wings 50 of the slider 21 perpendicularly to this plane. Preferably, these three dimensions will be substantially equal to allow effective guidance of the lever 20 relative to the slider 21 as relative to the gripper body 19 by flat sliding contact of each face 107 with a respective face 57 and a face 74.

In the extreme zone 98 of the lever 20 thus engaged between the wings 50 of the slider 21, the two wings 103 of the lever 20 are perforated along a same axis 108 perpendicular to the axis 97 and to the plane 18 by a respective cylindrical hole 109 generated by revolution about an axis 108. The holes 109 each have a diameter substantially identical to that of the semi-cylindrical bottom 69 of the edge 66 of each notch 64 of the slider 21, that is equal to the distance separating the flanks 67 and 68 of this edge 66 from one another. In these two holes 109 there is coaxially engaged a same cylindrical pin 110 along the axis 108 with a diameter substantially identical to that of the hole 109 and a dimension perpendicularly to the plane 18 substantially equal to that separating the two internal faces 28 of the housing 24 from one another perpendicularly to this plane.

Thus, by two extreme zones, which are symmetrical to one another about the plane 18, the pin 110 is engaged in the notches 64 of the slider 21 and connects the extreme zone 98 of the lever 20 to the slider 21 against any relative movement parallel to the axis 3, whether in the direction 17 in which the pin rests on the flank 67 of the edge 66 of each notch 64 or in the direction 27 in which the pin rests on the flank 68 of this edge, while allowing a relative deflection in the plane 65 common to the two notches 64.

It will be noted that the pin 110 can be mounted so as to slide along the axis 108 inside holes 109. This facilitates the pin's potential removal and re-assembly insofar as it is held by abutting along the axis 108 against the two internal faces 28 of the housing 24 when the extreme zone 98 of the lever 20 is engaged in the slider 21 which is itself engaged in the housing 24.

A further axis 111 is perpendicular to the plane 18 but offset toward the zone 106 of the edges 105 relative to the axis 97 and offset toward the extreme zone 99, parallel to this axis 97, relative to the axis 108. The wings 103 also include a respective cylindrical holes 112 about the axis 111, each with a diameter substantially identical to that of the semi cylindrical bottom 93 of the edge 91 of each of the oblong apertures 88. Thus the two holes 112 can coaxially receive a cylindrical shank 113 along the axis 111 and which, appropriately dimensioned perpendicularly to the plane 18, also traverses the two apertures 88. This allows guidance of the lever 20 during sliding, parallel to the axis 3 and relative to the gripper body 19, as well as guidance of the lever 20 in rotation about the axis 111 when the axis 111 coincides with the axis 95 of the bottom 93 of the edge 91 of the apertures 88, while holding the lever 20 in a symmetrical configuration about the plane 18. Opposite one of the faces 89 of the gripper body 19, the shank 113 integrally carries a head 114 as it projects along the axis 111 relative to the other face 89 and, in this region, also carries a removable abutment such as a circlip, allowing it to be held in the engaged state in the two holes 112 and the two apertures 88 while also allowing it to be removed and reassembled at will in order to separate the lever 20 from the gripper body 22. The slider 21 can thus be removed in the direction 27 through the edge 31. The slider 21 can thus be changed in the same way as the nose 23, and then the user can re-assemble the two. This method of holding the shank 113 has not been explicitly illustrated but it can easily be understood by a person skilled in the art.

Preferably, as illustrated, the distance separating the mean plane 65 (of the notches 64 receiving the pin 110) and the face 61 of the core 49 (placed in contact with the face 47 of the core 36 of the nose 23 from one another along the axis 3 in the rest position) is substantially identical to the distance, parallel to the axis 3, that separates the axis 95 of the bottoms 93 of the edges 91 of the apertures 88 and the edges 32 serving to support the face 47 of the core 36 of the nose 23 against the part 22 of the gripper body 19. Thus, in the rest position common to the lever 20 and to the slider 21, relative to the gripper body 19, the now combined axes 111 and 95 are located along the mean plane 65 of the notches 64 of the slider 21 in the same way as the axis 108 of the pin 110, which thus advantageously coincides with the axis 70 of the bottoms 69 of the edges 66 of the notches 64.

In order to hold the lever 20 and the slider 21 therewith elastically in this rest position relative to the gripper body 19 and in order to return them elastically to this position once a user has squeezed the handle 99 toward the handle 25, a kickover spring 115 is disposed substantially along the plane 18. The spring 115 is preferably pre-compressed between the transition zone 26 (between the handle 25 and the housing 24 of the gripper body 19) and a median zone 116 of the lever 20. To receive and hold the kickover spring 115, the transition zone 26 is recessed with a pocket 117, which opens into the zones 83, 84, 86, 87 of the face 76 of the passage 72 and in a zone of the face 73 located between the passage 72 and the handle 25. The pocket 117 is delimited, in a direction away from the plane 18, by two parallel plane faces 118. These faces 118 are symmetrically spaced perpendicularly about the plane 18 by a distance smaller than the distance mutually separating the faces 74 of the passage 72. Thus a respective portion of the zones 83, 84, 86 and 87 of the face 76 remains between each of the faces 74 and the pocket 117. The pocket 117 is also delimited in the direction 41 and in the direction 42 by respective faces 119 and 120. The face 120 is plane and approximately perpendicular to the axis 35, whereas the planar face 119 is oblique relative to the axis 35 and, for example, oriented at 45° to it so as to diverge from the face 120 in the direction 17 and thus facilitate the moulding when the pocket 117 issues directly from the moulding of the part 22 in a preferred manner. The faces 119 and 120 join together the faces 118 and are connected by a respective fillet to a bottom face 121 of the pocket 117. The bottom face 121 also connects the faces 118 to one another and has a plane configuration perpendicular to the plane 18 and, although located entirely below the axis 35, extends toward it in the direction 41.

The bottom face 121 supports a branch 122 of the spring 115 of which the kickover winding 123 is wedged to the connection between the bottom face 121 and the face 120. The kickover winding 123 of the spring 115 is held substantially along the plane 18 against rocking relative thereto by the faces 118 of the pocket 117. Preferably, the spring 115 is prevented from escaping accidentally from the pocket 117 without preventing its intentional removal. In the example illustrated, this is accomplished by a pin 126 which passes through the pocket 117 and, inside the pocket, through the winding 123. The pin 126 extends along an axis 127 perpendicular to the plane 18 and constitutes an axis for the fillet for connecting the bottom face 121 to the face 120. The pin 126 also removably engages coaxially on either side of the hole 117 respectively in coaxial holes 128 of the part 22. The other branch 124 of the spring 115 projects from the pocket 117 and, by way of the passage 72, relative to the face 73. The branch 124 is pre-stressed against the core 102 of the lever 20 in the zone 116 thereof between its wings 103, while having an orientation such that the branch 124 moves away from the axis 3 in the direction 17. Thus, progressive rocking of the lever 20 relative to the gripper body 19 as a result of squeezing the handles 99 and 25 is accompanied by an increase in the elastic stress of the spring 115 and can be accompanied by sliding of the branch 126 thereof against the core 102 of the lever 20 in a manner guided by the wings 103 thereof.

The respective rest positions of the lever 20 and of the slider 21 relative to the gripper body 19 constitute stable positions because the slider 21 is supported against the nose 23 in the direction 27 by the faces 36 and 47 of the support of the pin 110 in the same direction against the flank 67 of the edges 66 of the notches 64 of the slider 21. This is also due to the fact that a tendency of the spring 115 to cause the lever 20 to rock around the combined axes 108 and 70 relative to the slider 21 (in a direction away from the handle 99 of the lever 20 relative to the handle 25 of the gripper body 19) is countered by the shank 113 abutting against the flanks 92 of the edges 91 of the apertures 88. T his tendency can also be countered, as in the preferred embodiment illustrated, by localized support of the core 102 of the lever 20 against an abutment provided inside the passage 72. This abutment is further from the axis 3 in the direction 41 than the apertures 88, but closer to the axis 3 than the edge 80 in the direction 41 on the same side of the axis 71 as the face 75, but also closer to the axis 71 than the face 75 in the immediate vicinity of the face 73 of the part 22 and directly opposite the zone 80 of the face 76 in a direction parallel to the axis 3. In the example illustrated, this abutment has the form of a pin 129 passing through the passage 72 along an axis 130 perpendicular to the plane 18 and removably engaged coaxially on either side of the passage 72 respectively in coaxial holes 131 of the part 22. In its rest position the lever 20 is spaced both from the face 76 of the passage 72 by the zone 106 of the edges 105 of its wings 103 and from the face 75 of the passage 72 by its core 102.

Figure 4:
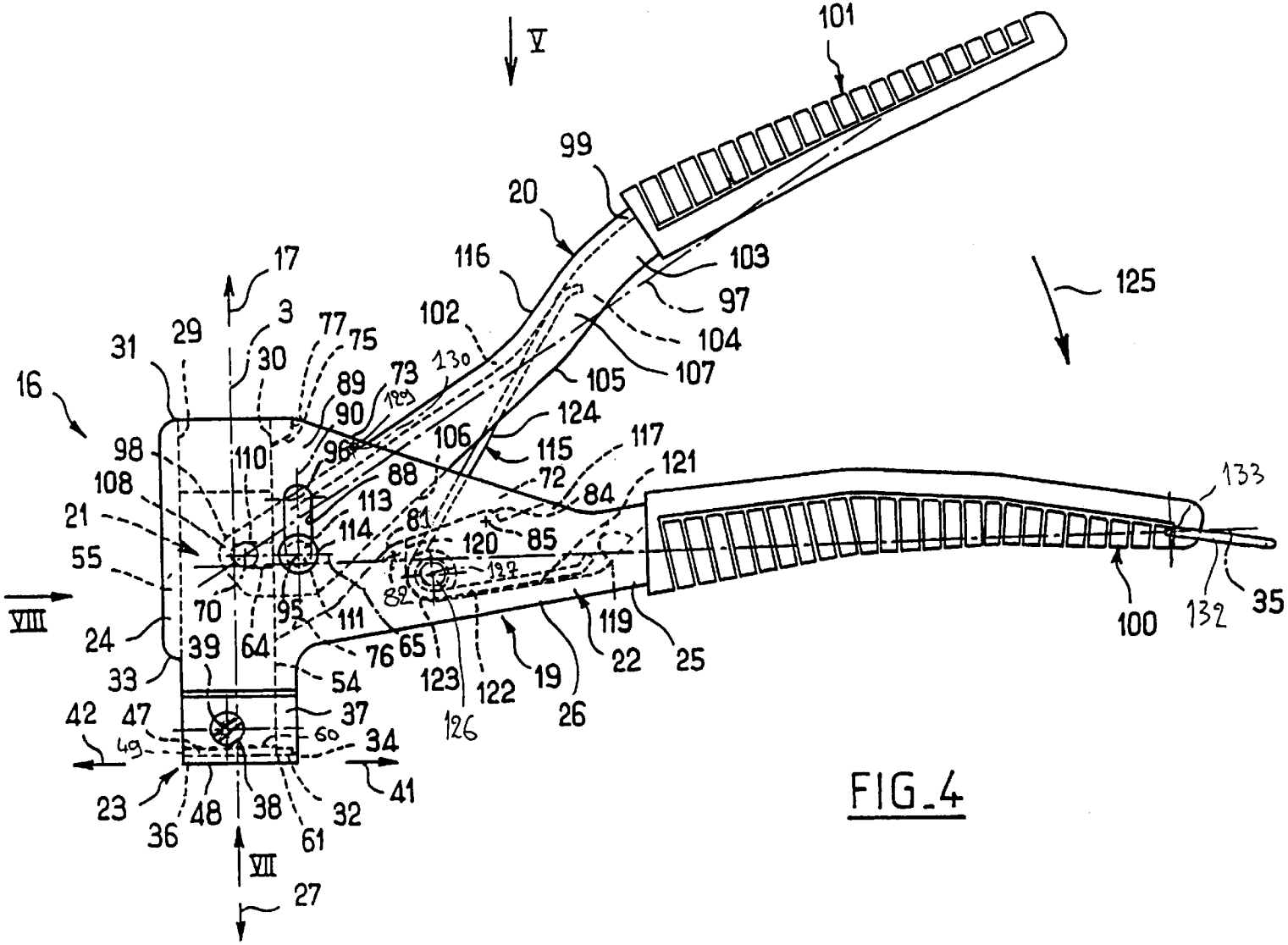
FIG. 4 is a lateral elevation of the gripper of FIG. 3, the gripper being in an orientation in which it has a vertical mean plane of symmetry and in which it is positioned for carrying out the setting illustrated in FIGS. 1 and 2.
Figure 5:
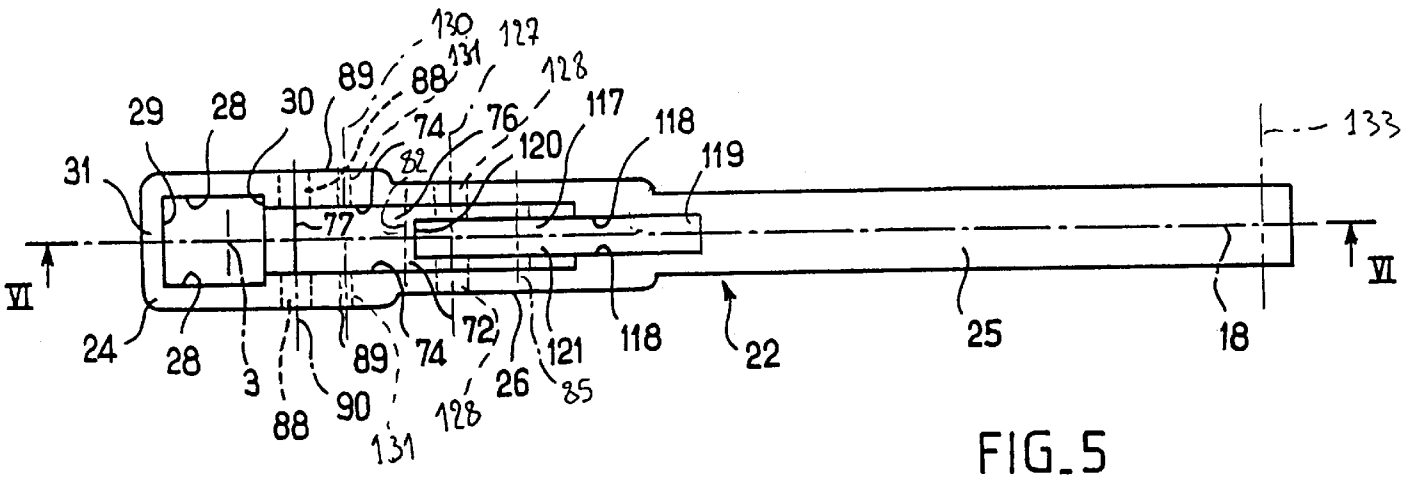
FIG. 5 is a plan view, in a direction designated by V in FIG. 4, of the body of the gripper having this orientation of FIG. 4.
Figure 6:
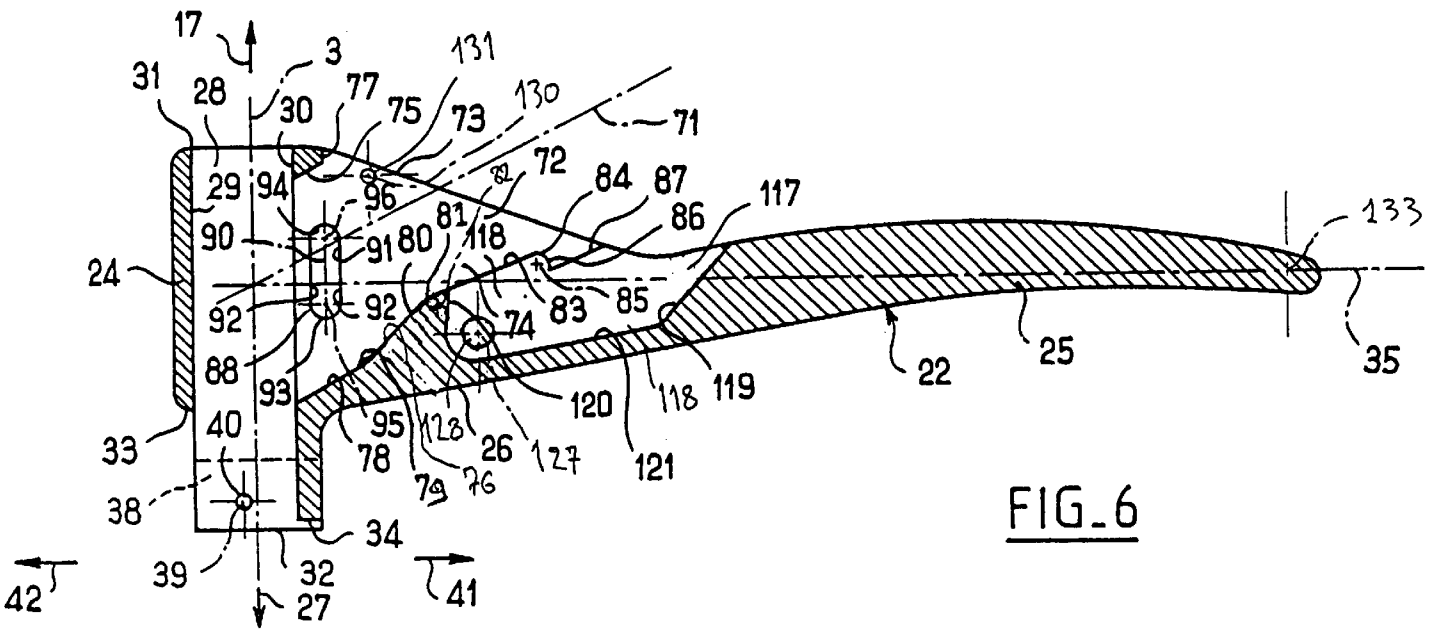
FIG. 6 is a sectional view of the gripper body through the aforementioned mean plane of symmetry, designated VI—VI in FIG. 5.
Figure 13:
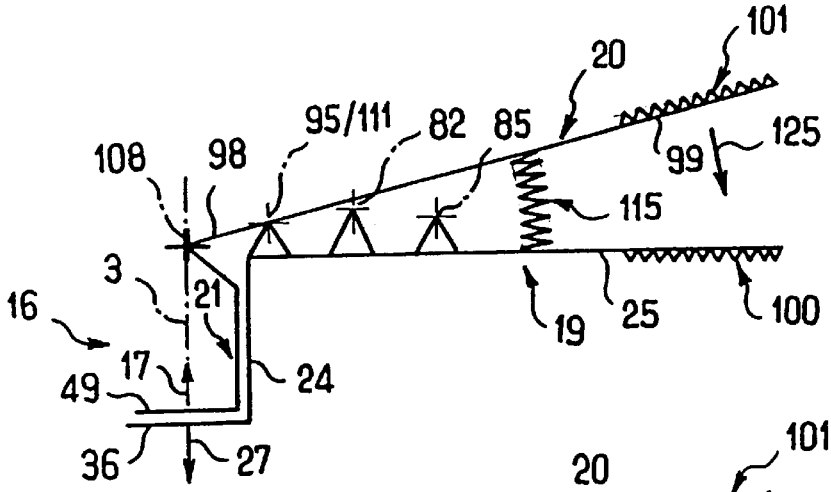
FIGS. 13 to 16 are schematic elevations corresponding to that in FIG. 4 of the gripper according to the invention illustrated in FIGS. 3 to 12 and three variations of this gripper respectively.

If a force is applied to the handle 99 of the lever 20 from this rest position in the direction toward the handle 25 of the gripper body 19 by squeezing or by clenching the hand, as shown diagrammatically by an arrow 125 in FIGS. 3 and 4 and in FIG. 13, this force is initially manifested by the lever 20 being supported by the shank 113 in the direction 27 on the bottom 93 of the edge 91 of the two apertures 88. Furthermore, the lever 20 rocks around the axis 111 which is thus combined with the axis 95 in the direction 125 relative to the gripper body 19 while moving away from the abutting pin 129. This rocking is manifested by the application (to the flank 68 of the edges 66 of the notches 64 of the slider 21) by the pin 110 of a force oriented in the direction 17. This force is applied such that the rocking of the lever 20 relative to the gripper body 19 around the combined axes 95 and 111 is manifested by a progressive spreading, in the direction 17, of the jaw constituted by the core 49 of the slider 21 relative to the jaw constituted by the core 36 of the nose 23 of the gripper body 19. One to the proportions of the lever 20 (such that the lever arm between the combined axes 95 and 111 and axis 108 of the pin is much smaller than the lever arm between the combined axes 111 and 95 and the handle 99 of the lever 20) a considerable force can thus be applied to the slider 21 in the direction 17 by applying a reasonable squeezing force to the handles 99 and 25. As a non-limiting example, a pulling force of about 200 daN can thus be developed in the direction of a displacement of the slider 21 in the direction 17 relative to the gripper body 19 by application to the handles 99 and 25 of a squeezing force of about 13 daN overtravel of 3 mm of the slider 21 in the direction 17 relative to the gripper body 19 from the rest position, for example.

The movement of the slider in the direction 17 relative to the gripper body 19 is accompanied by a sliding movement of the pin 110 in the notches 64 of the slider 21 in a direction away from the axis 3 but without the axis 108 of the pin leaving the mean plane 65 of the notches 64. The range of pivoting of the lever 20 around the combined axes 111 and 95 during this first phase of pivoting is sufficiently small, that is the range of displacement of the pin 110 inside the notches 64 of the slider 1 itself to remain small, that is, smaller than the dimension of the notches 64 in the plane 65 parallel to the plane 18.

The pivoting of the lever 20 around the combined axes 111 and 95 constitutes a first phase of pivoting of the lever 20 relative to the gripper body 19. This first phase is ended by the lever 20 coming to rest in the direction 27 (by way the zones 106 of the edges 105) against the zone 81 of the face 76 of the passage 72. This then initiates a second phase of pivoting of the lever 20, this time around the axis 82, relative to the gripper body 19.

During this second phase, the shank 113 slides in the direction 17 inside the two apertures 88 which hold the lever 20 against release from the gripper body 19, in a direction away from the axis 3, and consequently maintains the gripping of the lever 20 by the pin 110 with the notches 64 of the slider 21. This second phase of pivoting is accompanied by sliding of the zones 106 of the edges 105 of the lever 20 on the zone 81 of the face 76 of the passage 72. It is also accompanied by renewed sliding of the pin 110 inside the notches 64 of the slider 21 over a range which is however sufficiently limited for the pin 110 to remain engaged in these notches 6. In this case also, the axis 108 of the pin 110 remains disposed in the mean plane 65 of the notches 64. During this second phase, the lever arm between the pivot axis 82 of the lever 20 relative to the gripper body 19 and the axis 108 of the pin 110, (that is the zone of application of the pin 110 against the flank 68 of the edge 66 of the notches 64 of the slider 21 in the direction 17) is greater than that which existed during the first phase between the combined axes 111 and 95 and this axis 108 (or this zone of application of the force by the pin 110 to the slider 21). Thus the force available to continue the displacement of the slider 21 in the direction 17 relative to the gripper body 19 (for a given force applied to the handles 99 and 25 in the direction of coming together) is smaller than during the first phase. However, this reduction in the available force is immaterial insofar as the first phase of pivoting of the lever 20 relative to the gripper body 19 corresponds to the initiation of the deformation of the branches 5 of the plug 1. This initiation of such deformation necessitates a much greater force, applied by the jaw constituted by the core 49 of the slider 21 in the direction 17, to the head 13 of the screw 11 whereas the jaw constituted by the core 36 of the nose 23 holds the head 8 of the plug 1.

This second phase continues until the zones 106 of the edges 105 of the wings 103 of the lever 20 are applied flat to the zone 83 of the face 76 of the passage 72 on either side of the pocket 117 for receiving the spring 115. At the end of this second phase, the shank 113 occupies an intermediate position parallel to the axis 3 between the bottoms 93 and 94 of the apertures 88.

If a force is applied to the handle 99 in the direction 125 toward the handle 25, the lever 20 initiates a third phase of pivoting relative to the gripper body 19. During this third phase, by way the zones 106 of the edges 105 of the wings 103 being supported on the zone 84 of the face 76 of the passage 72, the lever 20 pivots round the axis 85 relative to the gripper body 19 while resting in the direction 27 against the zone 84. This pivot also occurs while applying a force in the direction 17 to the slider 21 by way of the pin 110 resting on the flanks 68 of the edges 66 of the notches 64. This third phase of pivoting can continue until the shank 113 abuts in the direction 17 against the bottoms 94 of the edges 91 of the apertures 88. The total range of the translation movement of the slider 21 in the direction 17 from the rest position is selected so as to be compatible with the longitudinal dimensions of any plug 1 in the range for which the gripper according to the invention 16 is intended. During this third phase of pivoting, the lever arm between the pivot axis 85 of the lever 20 relative to the gripper body 19 and the axis 108 of the pin 110 (that is the zone in which the pin 110 rests on the slider 21 in the direction 17) is again greater. Consequently, the force developed for the displacement of the slider 21 and of the screw head 13 in the direction 17 relative to the nose 23 of the gripper body 19 and relative to the head 8 of the plug 1, for a predetermined force applied to the handle 99 in the sense of approaching the handle 25 is smaller than it was during the second phase. This is not disadvantageous in the sense that the force to be developed in order further to further deform the branches 5 during this final phase is far lower. In contrast, it has an advantage in that the assembly formed by the screw 11 and the plug 1 is protected from the application of an excessive force which would cause the shank 12 to tear from the nut 4 held by the extreme ring 6 of the plug 1.

During the second and third phases, the lever 20 is urged toward the abutting pin 129. The lever 20 abuts the pin 129 when the shank 113 itself abuts in the direction 17 against the bottoms 94 of the edges 91 of the apertures 88 (due to an appropriate choice of dimensions based on the normal ability of a person skilled in the art). Also due to this choice, the two handles 99 and 25 also abut against one another by way of comfort sheaths 100 and 101. The mere release of the force applied to the handle 99 toward the handle 25 is sufficient to allow the return of the lever 20 and of the slider 21. The slider 21 is thus pushed in the direction 27 by the pin 110 resting against the flanks 67 by the effect of the spring 115. A ring 132 that is articulated to the handle 25, for example, around an axis 133 perpendicular to the plane 18, and that can be releasably pivoted around the handle 99 in this example, allows the handles 99 and 25 to be held temporarily closed in order to reduce the bulk of the gripper 16 for storage and transportation, in a manner not illustrated but well known in the field of tools.

FIG. 13 illustrates schematically the increasing distance, perpendicularly to the axis 3, between the successive axes 95 or 111, 82, 85 for pivoting of the lever 20 and for supporting the lever 20 on the gripper body 19 in the direction 27 relative to the axis 108, and for the pivoting of the lever 20 relative to the slider 21, as well as for the application of a force thereto in the direction 17 away from the jaw of the gripper body 19 (constituted by the core 36 of the nose 23) the axis 108 being shown roughly as intersecting the axis 3.

Figure 17:
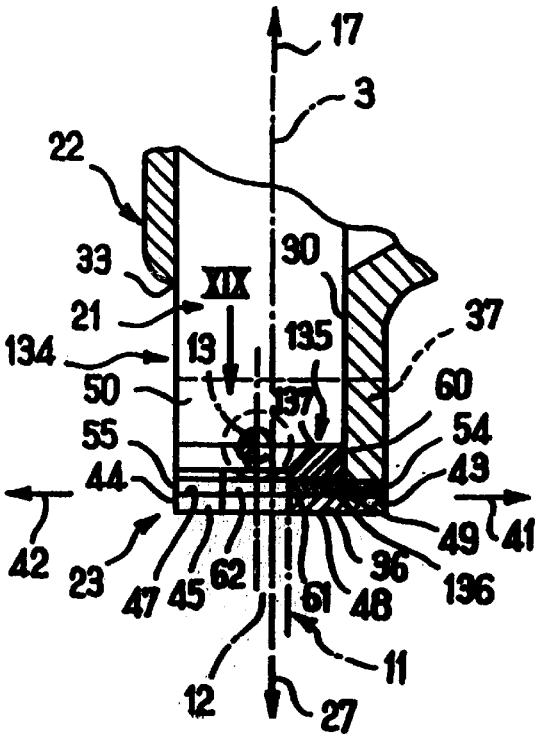
FIGS. 17 and 18 show, in a partial sectional view through the aforementioned mean plane of symmetry, as designated by VI—VI in FIG. 5, the gripper according to the invention as illustrated in FIGS. 3 to 12 but equipped with a removable adaptor allowing the setting of a metal anchor plug of the aforementioned type associated with a countersunk screw at the beginning and end of setting respectively.
Figure 18:
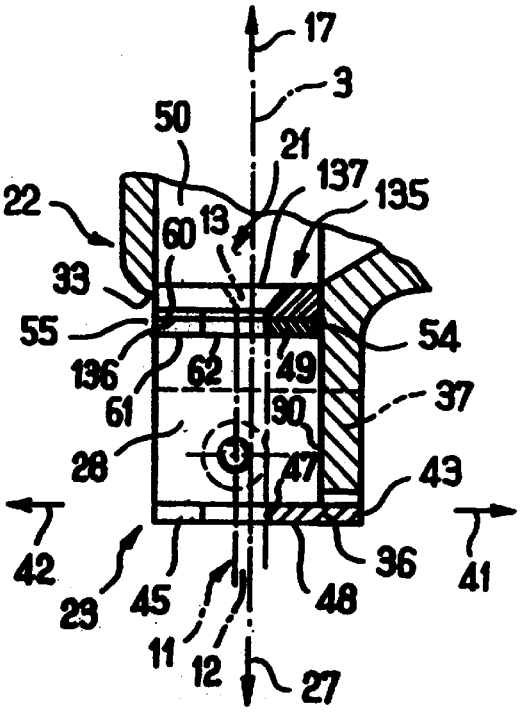
Figure 19:
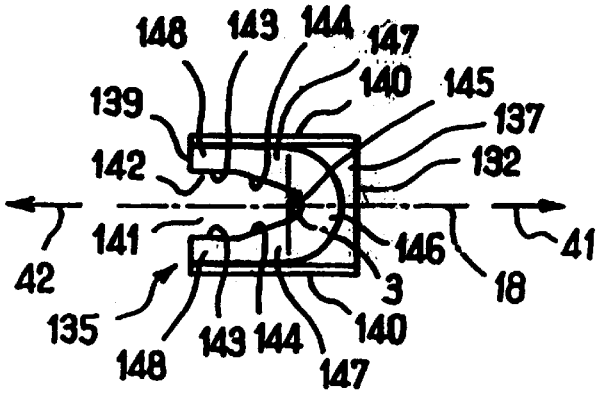
FIG. 19 is a plan view of the removable adaptor looking in a direction designated by an arrow XIX in FIG. 17.

The jaw constituted by the core 49 of the slider 21 of the gripper has a configuration more particularly suited to cooperation with a screw 11 with a flat head 13 due to the similarly flat shape of its face 60. When configured in this way, it can also cooperate with a screw having a milled head. But, for such an application, it is preferable to removably attach this jaw to the face 60 by introducing and adapter 135 through the space 134 inside the slider 21 occupying its rest position. The adapter 135 is described, with reference to FIGS. 17 to 19, in the position which it occupies when attached in this way to the face 60 of the core 49 of the slider 21 in order to cooperate with a screw 11 having a milled head 13, a screw of this type merely having been shown schematically by dot-dash in FIGS. 17 and 18. FIGS. 17 to 19 show that the adapter 135 has the general shape of a transverse plate delimited by two mutually parallel plane faces 136 and 137. The first of these faces 136 and 137 is oriented in the direction 27 and is applied flat to the face 60 of the core 49 of the slider 21 and of which the second is turned in the direction 17. The two faces 136 and 137 have a general rectangular shape identical to the general shape of the face 60 between the edges 54 and 55 and the faces 57 of the wings 50 of the slider 21.

The two faces 136, 137 are connected to one another in the directions 41 and 42 by two plane longitudinal edges 138 and 139. The edges 138 and 139 are perpendicular to the plane 18 and spaced apart perpendicular to the axis 3 by a distance identical to the distance separating the two edges 54 and 55 of the core 49 of the slider 21 perpendicularly to the axis 3. In the direction away from the plane 18, the two faces 138 and 137 are also connected to one another by two plane longitudinal edges 140. These edges 140 are parallel to the plane 18 about which they are mutually symmetrical and spaced perpendicularly to the plane 18 by a distance equal to that separating the faces 57 of the wings 50 of the slider 21 perpendicularly to this plane. Thus, when the adapter 135 is superimposed by its face 136 on the face 60 of the core 49 in its position of use illustrated in FIGS. 17 and 18, the edges 138 and 139 extend to the edge 54 and the edge 55 respectively in a co-planar manner, and the edges 140 are applied flat to the faces 57 of the wings 50 of the slider 21. The adapter 135 can be immobilized in this position relative to the slider 21 by any of a number of know attachments. For example, if the slider 21 is produced from steel, this removable fixing is advantageously produced by magnetisation, the adapter 135 being produced from an appropriate material such as a magnetised mild steel.

The edges 138 and 140 are continuous but the edge 139 is recessed by a notch 141 for passage of the shank 12 of the screw 11. The notch 141, in the region of the face 136, has a shape which is substantially identical to the shape, in a plan view, of the notch 62 of the core 49 of the slider 21 so as to coincide exactly with this notch 62 in the position of use of the adapter 135 shown in FIGS. 17 and 18. Unlike the notch 62, however, which has the same shape and the same dimensions in any transverse sectional view, the notch 141 flares progressively in the direction 17 in relation to the conicity of the head 13 of the screw 11. More precisely, over a small portion of its longitudinal dimension from the face 136 in the direction 17, the notch 141 is delimited on either side of the plane 18 by two flanks 142. The shape and dimensions of the flanks 142, in a plan view, are substantially identical to those of the flank 63 of the notch 62 located on the same side of the plane 18, or again substantially identical to those of the flank 46 of the notch 45 located on the same side of the plane 18. Thus each flank 142 longitudinally extends a respective flank 63 and flank 46.

In particular, each flank 142 has a plane zone 143 which extends a respective zone 149 of the flank 46 of the notch 45 in a co-planar manner by means of a corresponding plane zone of the flank 63 of the notch 62. Each flank 142 also has a plane zone 144 which extends a respective zone 150 of the flank 46 of the notch 45 in a co-planar manner by means of a respective corresponding plane zone of the flank 63 of the notch 62, as well as a zone 145 longitudinally extending the zone 151 of the flank 46 of the notch 45 by means of a corresponding zone of the flank 63 of the notch 62. From the zone 145, the flanks 142 of the notch 141 flare in the direction 17 in the form of a zone 146 in the shape of a portion of a truncated cone generated by revolution round the axis 3 forming an angle of 45° thereto. From each of the zones 144, the edge 142 flares in the direction 17 in the form of a respective plane zone 147 oriented at 45° to a co-planar geometric extension of the respective zone 144 and thus connected to the zone 146 in the direction 41. From each of the zones 143, the flank 142 also flares in the form of a respective plane zone 148 oriented at 45°, this time relative to a co-planar geometric extension of the respective zone 145 and to the plane 18. A person skilled in the art will easily understand that, depending on the diameter of the screw, a milled head 13 cooperates either with the zone 146 or with the zones 147 of the flank 142 which thus provide a stable support for this head as the displacement of the slider 21 and of the adapter 135 are brought about by activation of the lever 99 toward the lever 25, in the direction 17 away from the core 36 of the nose 23 of the gripper body 19. It is thus the assembly formed by the adapter 135 and the core 49 of the slider 21 which constitutes the jaw thereof, whereas the core 36 of the nose 23 still constitutes the jaw of the gripper body 19.

Other adapters having a design similar to that of the adapter 135 but with a configuration specifically adapted to each, case could also be provided to allow the gripper according to the invention 16 to be used to set various other anchoring devices of the plug 1 and screw 11 assemblies, for example.

Figure 14:
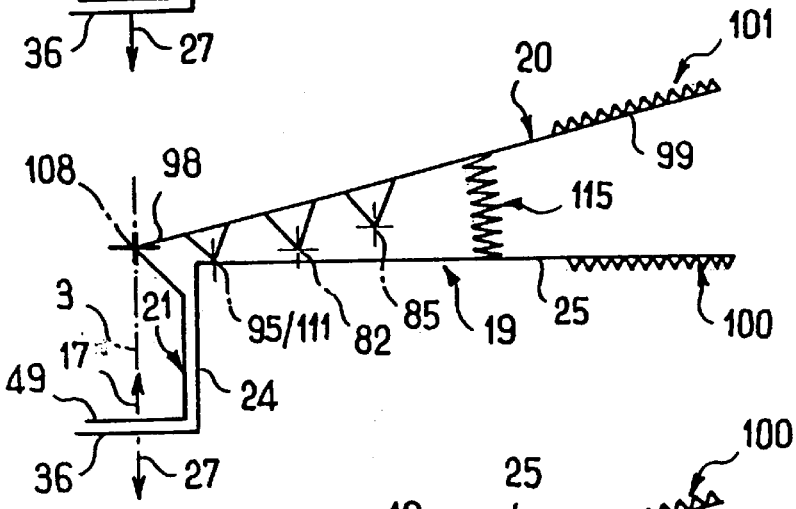
Figure 15:
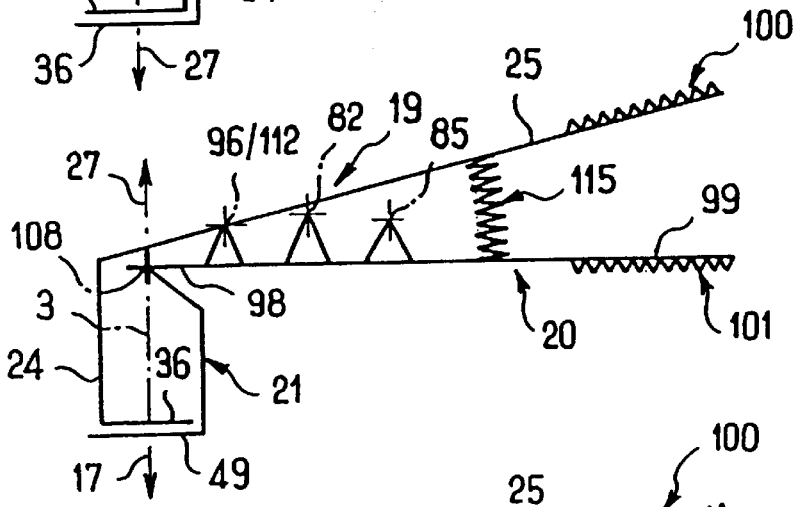
Figure 16:
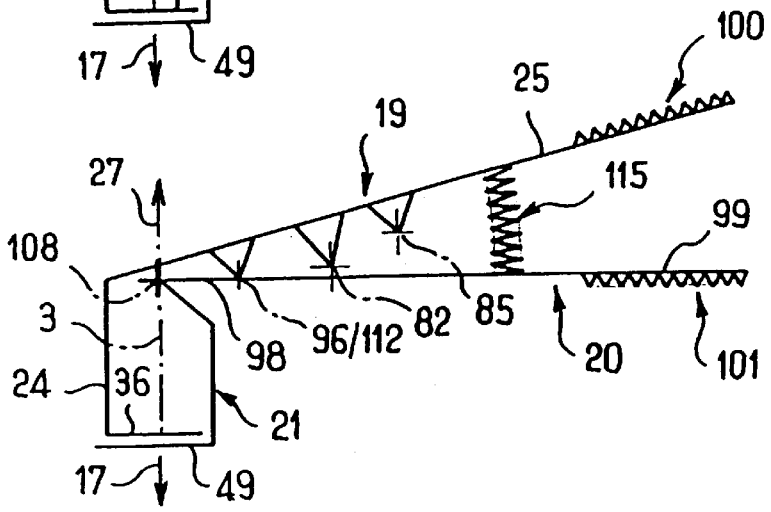

Although the embodiment of the gripper according to the invention 16 currently constitutes the preferred embodiment, other embodiments can be considered without departing from the scope of the present invention, and a range of variations has been illustrated schematically in FIGS. 14 to 16. The variation shown schematically in FIG. 14 is substantially identical to the embodiment described with reference to FIGS. 1 to 13 in many, if not most, ways. However, instead of being embodied by a particular configuration of the face 76 of the gripper body 19, the axes 82 and 85 are embodied by a particular configuration of the zone 106 of the edge 105 of the wings 103 of the lever 20. This configuration is in the form of a boss similar to that which the zones 80, 81, 83, 84, 86 of the face 76 form in relation to the zones 78 and 87. In this case, however, the face 76 can be planar or substantially planar, and the method of defining the axes 95 and 101 remains identical to that described hereinbefore.

FIGS. 15 and 16 show variations in which the two jaws, defined respectively by the core 36 of the nose 23 and the core 49 of the slider 21, are reversed similarly to the positions of the handles 25 of the gripper body 19 and the extreme zone or portion 99 of the lever 20. Thus the direction 17 of movement away from the jaw 49 of the slider 21 thus resting on the head 8 of the plug 1 relative to the jaw 36 of the gripper body 19, thus resting on the head 13 of the screw 11, is also reversed. In these variations, the method of defining the axis of rotation of the lever 20 relative to the gripper body 19 during a first phase of squeezing the handles 99 and 25 together can be carried out as indicated hereinbefore by cooperation of a pin 110 carried integrally by the lever 20 with the apertures 88. However, the axis 111 of the pin is thus combined with the axis 96 of the bottom 94 of the apertures 88, with the lever 20 actually being supported in the direction 27, currently reversed, on the gripper body 19. The other two pivot axes 82 and 85 can be defined as indicated hereinbefore, either by an appropriate boss of the lever 20 cooperating with a plane or at least smooth face of the gripper body 19, as illustrated in FIG. 15, or by a suitable boss of the gripper body 19 cooperating with a plane or at least smooth face of the lever 20, as shown diagrammatically in FIG. 16.

These variations of FIGS. 14 to 16 can easily be deduced in their concrete embodiments from the method of implementation described more completely with reference to FIGS. 1 to 13. It will be noted that each of them is compatible with cooperation with a flat head screw or with a milled head screw or again with other components of anchoring devices of the type concerned, if applicable, by removable assembly of an adapter 135 or the like on the core 49 of the slider 21 in the case of the embodiment in FIG. 14 or on the core 36 of the gripper body 19 in the case of the embodiments of FIG. 15 and 16. More generally, an adapter of this type with an appropriate configuration can be arranged on one and/or other of the jaws of the gripper according to the invention 16, namely on the core 49 of the slider 21 and/or the core 36 of the gripper body 19 in the case of the embodiment described with reference to FIG. 1 to 13, taking into account the variations described with reference to FIG. 14 to 16. This would be done either to allow the use of one gripper adapted to the setting of other types of anchoring device, or systematically (whatever the type of anchoring device) to prevent premature wear of the jaws. In all cases, magnetic fixing of the adapter on the corresponding jaw, for example, allows effective mutual connection and easy assembly and removal of the adapter if appropriate materials are used.

In addition to the variations disclosed above, a gripper according to the invention 16 can also include still further variations without departing from the scope of the present invention.

What is claimed is:

1. A setting gripper for an anchor device, the anchor device having two co-axial components of which each has a head and of which the heads are spread apart co-axially during setting, the setting gripper comprising:

a gripper body with a slotted aperture formed therethrough, the gripper body having a handle and a flat body jaw, the flat body jaw being disposed generally perpendicular to a predetermined axis, the slotted aperture being generally aligned generally parallel the predetermined axis;

a slider having a flat slider jaw that is disposed generally perpendicular to the predetermined axis and opposite the flat body jaw of the gripper body, the slider being guided so as to translate relative to the flat body jaw along the predetermined axis between a first position of relative rest, wherein the flat body jaw and the flat slider jaw are capable of being inserted together between the heads of the two components prior to setting the anchor device, and a second position, wherein the flat slider jaw is spaced axially apart from the flat body jaw along the predetermined axis;

a lever having a handle and a nose, the nose being spaced apart from the handle;

a notch being formed in one of the slider and the nose of the lever;

a first connection member disposed in the notch and coupling the nose of the lever and the slider, the first connection member coupling the lever and the slider such that the lever is rotatable relative to the slider and the lever is movable relative to the slider in a direction that is generally parallel an axis of the notch;

a second connection member coupled to the nose of the lever and disposed in the slotted aperture in the gripper body, the second connection member coupling the lever and the gripper body such that the nose of the lever is rotatable relative to the gripper body and the nose of the lever is movable relative to the gripper body in a direction that is generally parallel the predetermined axis;

a cam coupled to one of the gripper body and the lever; and a cam follower coupled to the other one of the gripper body and the lever;

wherein rotation of the handles of the gripper body and the lever toward one another permits the cam and the cam follower to cooperate to define a first outboard pivot point and a second outboard pivot point about which the lever pivots relative to the gripper body, the first outboard pivot point being positioned at a first distance from the second connection member, the second outboard pivot point being positioned at a second, greater distance from the second connection member;

wherein the point about which the nose of the lever pivots about the gripper body changes from an axis of the second connection member to the first outboard pivot point and then to the second outboard pivot point as the handles of the gripper body and the lever are rotated increasingly closer toward one another; and wherein the slider travels along the predetermined axis in response to the pivoting of the lever relative to the gripper body, and the leverage that is applied to the slider changes based upon the point about which the lever is pivoting relative to the gripper body.

2. The setting gripper of claim 1, wherein the first connection member is a cylindrically shaped pin.

3. The setting gripper of claim 1, wherein the second connection member has a generally cylindrical body that extends through the gripper body and the lever.

4. The setting gripper of claim 1, wherein the cam is coupled to the gripper body and the cam follower is coupled to the lever.

5. The setting gripper of claim 1, wherein the cam is integrally formed on the gripper body.

6. The setting gripper of claim 4, wherein the cam follower is integrally formed on the lever.

7. The setting gripper of claim 1, further comprising a spring coupled to the gripper body and the lever, the spring urging the handle of the gripper body and the handle of the lever apart from one another and biasing the slider into the first position.

8. The setting gripper of claim 1, wherein the flat body jaw and the flat slider jaw are interchangeable.

9. The setting gripper of claim 8, wherein the gripper body includes an interchangeable nose to which the flat body jaw is coupled.

10. The setting gripper of claim 1, wherein the notch is formed in the slider, the notch including a top surface, a bottom surface and at least one lateral surface that interconnects the top and bottom surfaces, the top and bottom surfaces being generally parallel to the axis of the notch.

11. The setting gripper of claim 1, further comprising an adapter that is removably attached to at least one of the flat body jaw and the flat slider jaw, the adapter being configured to act as an intermediary between the at least one of the flat body jaw and the flat slider jaw and a corresponding component of the anchoring device.

12. The setting gripper of claim 11, wherein the adapter is fixed magnetically to the at least one of the flat body jaw and the flat slider jaw.

13. The setting gripper of claim 1, wherein the first outboard pivot point is a center of a convex surface in the form of part of a cylinder of revolution formed on the cam.

14. The setting gripper of claim 1, wherein the second outboard pivot point is a center of a convex surface in the form of part of a cylinder of revolution formed on the cam.

15. A setting gripper for a co-axial anchor device, the anchor device being configured to be spread apart co-axially during setting, the setting gripper comprising:

a gripper body having a handle and a flat body jaw, the flat body jaw being disposed generally perpendicular to a predetermined axis;

a slider coupled to the gripper body, the slider having a flat slider jaw that is arranged generally perpendicular to the predetermined axis and opposite the flat body jaw, the slider being guided so as to translate the flat slider jaw relative to the flat body along the predetermined axis between a first position of relative rest, wherein the flat body jaw and the flat slider jaw are proximate one another, and a second position wherein the flat body jaw and the flat slider jaw are spaced apart from one another along the predetermined axis;

a lever having a handle and a nose, the nose being pivotably coupled to the slider at a slider pivot point, the lever also being coupled to the gripper body and rotatable about three lever pivot points, each of the lever pivot points being increasingly offset from the slider pivot point;

wherein the lever pivots about a first one of the pivot points when the slider is positioned in the first position and shifts to a second one of the pivot points and then to a third one of the pivot points as the handle of the lever is rotated closer to the lever of the gripper body.

16. The setting gripper of claim 15, wherein a cylindrically shaped pin couples the slider and the lever.

17. The setting gripper of claim 15, wherein a pin having a generally cylindrical body extends through and couples the gripper body and the lever.

18. The setting gripper of claim 15, further comprising a spring coupled to the gripper body and the lever, the spring urging the handle of the gripper body and the handle of the lever apart from one another and biasing the slider into the first position.

19. The setting gripper of claim 15, wherein the flat body jaw and the flat slider jaw are interchangeable.

20. The setting gripper of claim 19, wherein the gripper body includes an interchangeable nose to which the flat body jaw is coupled.

21. The setting gripper of claim 15, further comprising an adapter that is removably attached to at least one of the flat body jaw and the flat slider jaw, the adapter being configured to act as an intermediary between the at least one of the flat body jaw and the flat slider jaw and a corresponding component of the anchoring device.

22. The setting gripper of claim 21, wherein the adapter is fixed magnetically to the at least one of the flat body jaw and the flat slider jaw.

* * * * *

UNITED STATES PATENT AND TRADEMARK OFFICE

CERTIFICATE OF CORRECTION

PATENT NO. : 6,474,129 B1
DATED : November 5, 2002
INVENTOR(S) : Robert Anquetin It is certified that error appears in the above-identified patent and that said Letters Patent is hereby corrected as shown below:

Column 24,
Line 1, "claim 1" should be -- claim 4 --.

Signed and Sealed this

First Day of April, 2003

JAMES E. ROGAN
*Director of the United States Patent and Trademark Office*